US012616261B2

(12) United States Patent
Spataro

(10) Patent No.: US 12,616,261 B2
(45) Date of Patent: May 5, 2026

(54) DRAWSTRING THAT MEASURES USER

(71) Applicant: Eric Andrew Spataro, Houston, TX (US)

(72) Inventor: Eric Andrew Spataro, Houston, TX (US)

( * ) Notice: Subject to any disclaimer, the term of this patent is extended or adjusted under 35 U.S.C. 154(b) by 655 days.

(21) Appl. No.: 17/821,164

(22) Filed: Aug. 20, 2022

(65) Prior Publication Data

US 2024/0057703 A1 Feb. 22, 2024

(51) Int. Cl.
*A41F 9/02* (2006.01)
*A41H 1/02* (2006.01)

(52) U.S. Cl.
CPC ..... *A41F 9/025* (2013.01); *A41H 1/02* (2013.01)

(58) Field of Classification Search
CPC ..... A41F 9/025; A41H 1/02
See application file for complete search history.

(56) References Cited

U.S. PATENT DOCUMENTS

2011/0083331 A1* 4/2011 Hopman ..... A41H 1/02 33/2 R
2018/0177253 A1* 6/2018 Ritchie ..... A41F 9/025
2024/0057703 A1* 2/2024 Spataro ..... A41F 9/025

FOREIGN PATENT DOCUMENTS

JP 3165860 U * 2/2011

* cited by examiner

*Primary Examiner* — Yaritza Guadalupe-Mccall

(57) ABSTRACT

A measuring apparatus comprising a drawstring member made of a flexible and non-stretchy material formed into a drawstring that is both wearable and a measuring apparatus to be integrated into an article of clothing. The drawstring has a front surface with measurement indicia permanently illustrated thereon. The measurement information includes a plurality of specific measurements and a graphical representation corresponding to each specific measurement. The measurement indicia can be in standard and/or metric units on one or more sides of the drawstring member.

15 Claims, 2 Drawing Sheets

DRAWSTRING THAT MEASURES USER

TECHNICAL FIELD

The present invention relates to a drawstring. More specifically, this invention relates to a measuring drawstring with indicia viewable to user when utilized in an article of clothing (e.g., sweatpants, shorts, etc.)

BACKGROUND

Regular drawstrings cinch and hold clothing, but do not have the capacity to measure. With the concerns of one's weight and the many products invented prior to address this problem, none give the simple measurement feedback needed to help. Whether someone is overweight or in good shape, keeping a constant keen eye on one's body circumference is very important.

Waist circumference measurement has been established as a better predictor of disease risk (e.g., diabetes risk, obesity risk, etc.) than body mass index (BMI).

During Covid-19 restrictions, quarantines, and remote working, dress pants were traded in for sweatpants and weight gain has become even more problematic.

Obesity has been a well-recognized serious health problem in the United States for decades, significantly contributing to shortening lives and increasing medical expenses for millions of Americans. Many diseases, such as type II diabetes, hypertension, hyperlipidemia, heart disease, and others have been directly linked to obesity. Unfortunately, the threat of a reduced lifespan, reduced quality of life and an enhanced probability of suffering from comorbid diseases in the future is not sufficient for those who are significantly overweight to be successful in reducing their weight and in maintaining such a reduced weight, and a healthy lifestyle incorporating a consistent exercise program.

The causes of obesity are multiple and can be complex. Genetic predispositions impacting metabolism and environmental factors such as diminished physical activity often play a key role. For some individuals additional psychological factors such as stress and depression and medical conditions such as hypothyroidism, chronic pain and other conditions that restrict physical activity or affect metabolism all can contribute in varying degrees in causing obesity.

Given the complexity of obesity, there are many approaches to its treatment. At the most basic level, treatment involves the manipulation of energy intake and energy expenditure. To lose weight one must take in fewer calories than one expends. To attain this objective, diets limiting the intake of calories are typically coupled with exercise to increase energy expenditure and thus create negative energy balance. Along with this, however, when restricting calories, one must be aware of the nutritional needs of the body. Healthy weight loss is best achieved when nutritional requirements of the body are fulfilled during the process of limiting caloric intake.

Since many individuals suffering from obesity also are afflicted with co-morbid medical conditions, the determination of appropriate nutritional intake, caloric restriction and exercise regimens should take account these conditions and, often, the medications associated with them.

In this country, there is significant variation in the approaches available to address obesity. Many commercial programs exist, such as Weight Watchers, which provide nutritional and exercise direction along with help to keep on track. There are many individual health care professionals that provide specific weight management services such as nutritionists, trainers, exercise physiologists, counselors, psychologists, nurses and physicians. In some areas, there are more comprehensive programs available at multidisciplinary medical weight management centers where medical management, nutrition, exercise and psychological intervention are provided in a global, coordinated approach. Also, there are surgical approaches available offering a number of procedures aimed at altering caloric intake and absorption.

In addition to services and programs, there are a myriad of weight loss products available. FDA approved prescription medications, herbal products and over the counter products to stimulate metabolism and to increase satiety, prepackaged, low and zero calorie foods and beverages and many other products are available to alter caloric intake. Exercise machines, devices and videos are also available to encourage increased energy expenditure.

In the end, the success of individuals, whether it be losing weight and maintaining the weight-loss or any health enhancement endeavor is most affected by their ability to make positive behavior changes and to maintain those positive behaviors indefinitely.

Well-known programs, such as Weight Watchers, have employed weight-loss monitoring data processing systems that have been helpful to participants in this program. In recent years, weight-loss applications have become available for use with phones and tablets to assist dieters in successfully meeting their weight loss goals.

While existing weight-loss computing systems have a variety of useful features, such systems are typically cumbersome to use due in part to the complexities of adequate data entry. The difficulties in various data entry steps in such systems are likely to discourage consistent use over a long period of time for many users.

Moreover, there is a need for a diet, exercise and behavioral monitoring system that provides the user with a structured system for addressing the old adage "you are what you eat" in part by providing feedback in real time to the user as to food consumed, exercise performed and/or progress towards goal achievement.

As used herein, it should be understood any feature identified as being used in one illustrative implementation, is contemplated as being usable in any other illustrative implementation identified herein. Thus, merely because a feature is not expressly identified as being used in a particular illustrative implementation should not be interpreted as an indication that it is not contemplated for use in that implementation. Similarly, any reference herein to "in an implementation/embodiment" or the like should be interpreted as indicating a contemplation of use in any desired implementation. Further, reference to a feature or a set of features being used in "illustrative implementations" should not be construed as an indication that some or all of such features must be used in "all" implementations.

SUMMARY

The present invention seeks to provide a solution to this problem by providing a measuring drawstring with indicia to simplify the way in which a person can accurately observe and track their body measurements at any given moment, having such drawstring within the garment of choice, typically sweatpants, joggers, or shorts.

The present invention achieves the above-stated objective by including with a drawstring, measurement indicia which is readily observable by the user looking downwardly.

The indicia simplify measurement determination because there is no need for the user to seek a cumbersome measuring tape. Thus, the possibility of not knowing one's current measurement is reduced greatly. These advantages result from the ability to visually determine measurements by simply looking at the measuring drawstring where the ends meet with no slack.

According to the preferred embodiment of the invention, the drawstring has two ends and can be of any length. The drawstring bears permanent measurement indicia on its surface to visually determine the measurement of the user.

The measurement indicia on the surface of the present invention preferably starts at zero in the middle of the drawstring measuring outwards towards each of the ends. The present invention can bear standard units of measurement and/or metric units on one or more sides of the drawstring. The units of measurement can be placed perpendicularly, horizontally, straight, or diagonally along the drawstring. Among the measurement units indicia can be additional indicia forming shapes of any size or color, such as lines, dots, stars, squares, circles, etc., for reference points and markers.

The drawstring can be formed of any suitable material and via any suitable process, although flexible and non-stretching material is preferred.

These and other features will be more readily understood in view of the following detailed description and drawings.

BRIEF DESCRIPTION

For a more complete understanding of the present invention, and the advantages thereof, reference is now made to the following descriptions taken in conjunction with the accompanying drawings, in which.

REFERENCE NUMBERS

100—Drawstring
102—Drawstring End
104—Indicia
106—Buckle
108—Clothing Article/Garment

DETAILED DESCRIPTION

Figure 1:
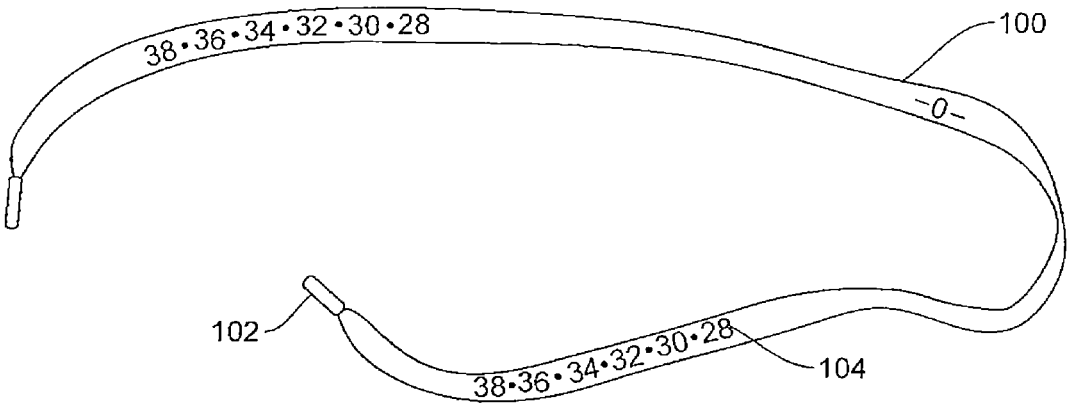
FIG. 1 illustrates the top perspective view of the measuring drawstring outside of clothing article.
Figure 2:
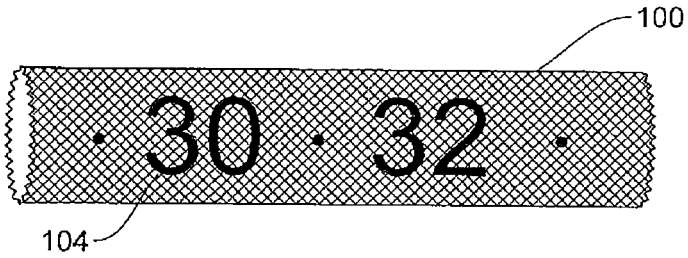
FIG. 2 is a close-up, side perspective view of a segment of the measuring drawstring.
Figure 3:
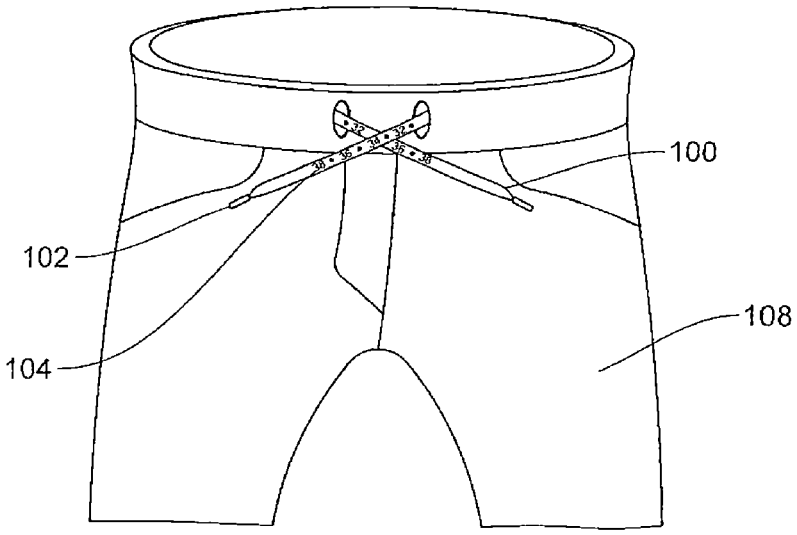
FIG. 3 is a side perspective view of measuring drawstring installed into clothing article, ready to use, also showing how measurement is taken, by bringing both ends together with no slack.

FIGS. 1-3 show preferred embodiment of the present invention, showing measurement indicia from one or more sides, matching the indicia to indicate measurement is by having the ends pull outwards equally and at the nearest spot to user's body the measurement is taken while user crosses them to tie a bow style "bunny ears", or by simply temporary crossing them to observe measurement and released into two separate hanging ends, as for a comfortable relaxed wearing style. The measuring drawstring simplifies comfort and convenience of measuring oneself or one another, such as a child or parent to keep track of weight and health by having a constant accessibility to important measurement data and spotting changes or fluctuations in measurements while wearing a garment/clothing article equipped with the measuring drawstring installed. Measuring drawstrings can be installed into articles of clothing from garment manufactures and/or sold separately so that consumer can install the measuring drawstring into their personal clothing articles by simply swapping them out for one to allow all garments accessibility to the present invention and its innovative features. The measuring drawstring can be constructed of any material, preferably of the flexible and non-stretching type, such as cotton, synthetic, leather, plastic, etc., and of woven, braided, solid, etc. structure, and can be any shape such as flat, rounded, squared, etc., with the measuring indicia on one or more sides being permanently affixed onto drawstring by being printed-on, sewn-on, ironed-on, thermoformed, etc., the drawstring ends can be of any design such as folded and sewn, knot, sewn, heat-shrink plastic, plastic, metal, wood, etc. allowing for defined and solid endpoints to the measuring drawstring. The measuring indicia can bear standard units of measurement and/or metric units on one or more sides of the drawstring.

Figure 4:
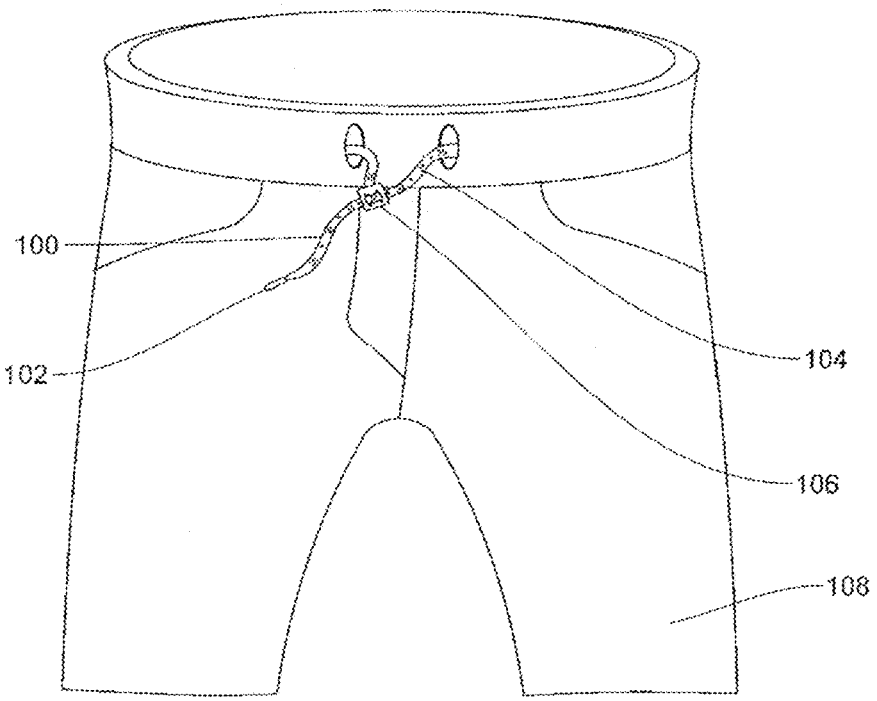
FIG. 4 is an illustration showing a side perspective view of an embodiment with a buckle while installed into an article of clothing.

FIG. 4 shows alternate embodiment of the present invention showing the buckle being absolute zero and measures outwards towards the other drawstring end, when buckle is cinched up with no slack the buckle will intersect the measurement indicia and read the measurement of the user at such point of intersection. Only one drawstring end would hang down as the other ends with a simple sliding buckle to allow for quicker cinching of the garment it is installed in all while providing a clear indication of a user's measurement. The buckle can be constructed of hard plastic, metal, wood, etc., or any other suitable rigid material. The preferred design of the buckle would be a simple two openings where it is strung through to allow for tightening and holding of drawstring without having to tie a bow or "bunny ears", which makes it especially suitable for children or those of older age that may have issues with finger dexterity needed for tying a bow or "bunny ears". When the buckle is tightened the remaining drawstring that is left hanging can be tucked away behind the buckle to keep it from dangling or hanging too low. To loosen the drawstring in this embodiment the user would simply pull the buckle outwards away from the users body to give it slack to allow for comfort or removal of garment. The construction of the measuring drawstring in this embodiment is exactly the same as the preferred embodiment in material, shape, size, indicia, etc., and only differs with the inclusion of the buckle attached to one end of the drawstring by adhesive, pressure, thermal, or any other means of attachment. The other difference is the orientation of the measurement indicia starting from the buckle being zero outwards towards the other end measuring at its furthest point and when tightened or cinched-up with no slack remaining is where the measurement is taken.

Figure 5:
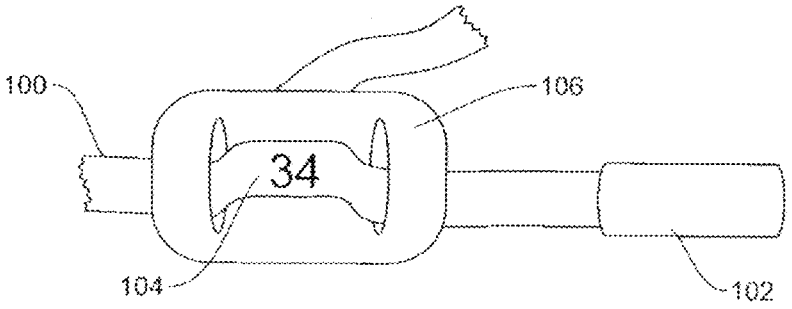
FIG. 5 illustrates a top perspective view of drawstring going through the buckle.

FIG. 5 shows a top perspective view of the drawstring going through the buckle. The close-up view shows how one end is snaked through one opening and out the other then slide it back as the drawstring is pulled outwards. The buckle openings should be snug on the drawstring for it to create sufficient friction to hold it in place, but not too tight or it will not slide freely when needed. The buckle can be attached to drawstring by adhesive, crimping, thermal, etc. The attachment of the buckle and drawstring can be anywhere, but preferably on the opposite of where the drawstring runs, so that they are perpendicular to each other. The observation of the measurement would be in the center of the buckle where drawstring loops.

FIG. 1 shows a measuring drawstring 100, outside of a garment/clothing article, with the drawstring ends 102 on each end, and measurement indicia 104, starting with zero in the middle of the overall length as shown, with measurement indicia 104 equally measuring up as it goes outwards towards each drawstring end 102. Depending on the size of clothing article/garment the drawstring 100 is used in the measuring indicia 104 may start at the thirty inch point on each end as an example, because for instance on large sweatpants thirty two inches may be the minimum indicia 104 on each side necessary or visible to user, the smaller sizes could comprise of a shorter drawstring 100 and have a lower minimum e.g. twenty eight inches, due to smaller clothing article/garment used requiring an overall different circumference. The indicia 104 can be utilized along the entire length of the drawstring 100 and multiple sides of said drawstring 100. Drawstring 100 can be constructed of any suitable material that is both flexible and made of the non-stretching variety, such as cotton, leather, plastic, etc. The measuring indicia 104 can be of any permanent methods of application such as printed-on, sewn-on, ironed-on, thermoformed, etc. The drawstring ends 102 can be plastic, metal, wood, sewn, knotted, etc., and can be attached by heat-shrinking, crimping, thermal, adhesive, etc.

FIG. 2 shows a fragmentary close-up perspective view of the measuring drawstring 100, and indicia 104 showing measurements and markings.

FIG. 3 illustrates a side perspective view of the measuring drawstring 100 installed into an article of clothing/garment 108, ready to use and showing how measurement is taken, by bringing both drawstring ends 102 together with no slack while matching same measurement indicia 104 from both of the drawstring ends 102. The article of clothing 108 can be of any type such as shorts, sweatpants, joggers, etc. The measuring drawstring 100 can be installed and sold together with clothing article/garment 108 and/or sold separately so that a user can benefit from the innovations in their previously purchased garments 108.

FIG. 4 illustrates a side perspective view of an alternate embodiment of drawstring 100 with a buckle 106 while installed into a clothing article 108. In this embodiment the measuring indicia 104 goes from zero at the buckle 106 and counts up as it goes towards the drawstring end 102, the buckle 106 will cinch up clothing article 108 as the drawstring end 102 is pulled outward while the buckle 106 is held near clothing 108 and can be pushed back slightly to remove any slack, the user can tuck away the long drawstring end 102 behind the buckle 106 if desired. The buckle 106 can be constructed of any rigid material such as metal, plastic, wood, etc. The buckle 106 can be of any variety such as a simple glider design, which allows the drawstring end 102 into one opening and strung through into the other opening.

FIG. 5 shows a top perspective close-up view of a fragment of the drawstring 100 going through the buckle 106. The close-up view shows how one drawstring end 102 is snaked through one opening and out the other then slides it back as the drawstring 100 is pulled outwards. The openings in the buckle 106 should be snug on the drawstring 100 for it to create friction for it to hold in place, but not too tight or it will not slide freely when needed. The buckle 106 can be constructed of any suitable rigid material such as plastic, metal, wood, etc. The buckle 106 can be made by many methods such as thermo-formed, 3D printed, casted, molded, forged, milled, etc. The buckle 106 can be attached to drawstring 100 by adhesive, thermal, crimping, clamping, etc. The attachment of the buckle 106 and the drawstring 100 can be anywhere but would be preferably attached on the opposite side of where drawstring 100 runs, so that they are perpendicular to each other. The observation of the measurement indicia 104 would be in the center of buckle 106 where drawstring 100 loops into it. The use of a buckle 106 allows for easy operation by both children and adults who have finger dexterity problems that would otherwise have issues with tying a traditional drawstring 100. Various other designs for a simple buckle 106 may be utilized such as cord locks and fastener toggles.

It should be understood the above embodiments are cited for purposes of illustration and that the present invention is not limited to what has been particularly shown and described above. Rather, the scope of the present invention includes combinations and sub-combinations of the various features described above and include those variations and modifications not found in the prior art that will occur to those skilled in the art upon reading the above description.

The invention claimed is:

1. A measuring apparatus comprising: a drawstring member formed of a flexible and substantially non-stretching material; said drawstring member having a main surface with permanent measurement indicia thereon, the indicia corresponding to waist circumference measurements; wherein the drawstring has a central zero located at the midpoint of its overall length, with measurement indicia extending symmetrically outward in equal increments toward each end; such that, when the drawstring is worn about the waist and snugly tightened with little to no slack, the point of cinch, overlap, or fastening aligns with the measurement indicia to indicate the user's current waist measurement.

2. The measuring apparatus of claim 1, wherein the drawstring comprises symmetrical ends each having matching measurement indicia, such that when the ends are overlapped snugly around the waist, the point of overlap indicates the user's waist circumference.

3. The measuring apparatus of claim 1, wherein the drawstring comprises a securing element selected from the group consisting of a buckle, cord lock, or fastener toggle, wherein the securing element is the zero point and the waist circumference is identified by the indicia aligned with the securing element when fastened snugly.

4. The measuring apparatus of claim 1, wherein the drawstring is configured to be integrated into an article of clothing selected from sweatpants, shorts, athletic wear, or other garments having a waistband.

5. The measuring apparatus of claim 1, wherein the drawstring is configured to function as a stand-alone waist circumference measuring tool independent of integration into clothing.

6. The measuring apparatus of claim 1, wherein the drawstring comprises a surface constructed of flexible, non-stretching material selected from braided or woven fabric, cotton, plastic, leather, or composites.

7. The measuring apparatus of claim 1, wherein the drawstring body may be formed in flat, round, square, or other suitable cross-sectional shapes.

8. The measuring apparatus of claim 1, wherein the measurement indicia are applied by printing, heat transfer, embroidery, embossing, fusing, or other permanent methods known in the art.

9. The measuring apparatus of claim 1, wherein the measurement indicia are displayed in units selected from metric, standard, or other recognized measurement systems, and may be represented numerically, alphanumerically, or symbolically.

10. A method of measuring a waistline, comprising: placing the drawstring member of claim 1 around the waist; tightening the drawstring until it is snug with little to no slack; observing the measurement indicia located at the cinch point, overlap point, or fastening point of the drawstring to determine waist circumference.

11. The method of claim 10, wherein the drawstring comprises symmetrical ends and the waist circumference is determined by observing the matching indicia at the point of overlap when snug.

12. The method of claim 10, wherein the drawstring includes a securing element selected from a buckle, cord lock, or fastener toggle positioned at one end of the drawstring and serving as a zero marker, and the waist circumference is determined by tightening the drawstring snugly around the waist and observing the measurement indicia aligned with the securing element.

13. The method of claim 10, wherein fluctuations in waist circumference are tracked by repeated tightening and observing changes in the indicia over time.

14. The method of claim 10, wherein the tactile sensation of the drawstring tightening or loosening provides behavioral feedback prompting user awareness of body circumference changes.

15. The method of claim 10, further comprising tracking fluctuations in waist circumference by performing a first measurement and repeating the measurement after a meal, period of fasting, exercise, or other condition, and comparing the results to monitor changes over time.

* * * * *